US007621777B2

(12) United States Patent
Thelen

(10) Patent No.: US 7,621,777 B2
(45) Date of Patent: Nov. 24, 2009

(54) ELECTRIC PLUG CONNECTOR FOR WALL FASTENING

(75) Inventor: Maik Thelen, Holzgerlingen (DE)

(73) Assignee: CONINVERS GmbH, Herrenberg (DE)

( * ) Notice: Subject to any disclaimer, the term of this patent is extended or adjusted under 35 U.S.C. 154(b) by 98 days.

(21) Appl. No.: 11/942,844

(22) Filed: Nov. 20, 2007

(65) Prior Publication Data

US 2008/0119073 A1 May 22, 2008

(30) Foreign Application Priority Data

Nov. 22, 2006 (DE) ..... 20 2006 017 885 U

(51) Int. Cl.
*H01R 13/73* (2006.01)

(52) U.S. Cl. ..... 439/559; 439/544

(58) Field of Classification Search ..... 439/131, 439/544, 548, 559, 562, 569, 571; 403/230
See application file for complete search history.

(56) References Cited

U.S. PATENT DOCUMENTS 3,790,698 A * 2/1974 Engert ..... 174/152 R
5,213,520 A * 5/1993 Casey et al. ..... 439/559
5,947,766 A * 9/1999 Tsuji et al. ..... 439/559
6,083,040 A * 7/2000 Mosquera ..... 439/548

FOREIGN PATENT DOCUMENTS

DE 200 07 171 U1 8/2001

* cited by examiner

*Primary Examiner*—Michael C Zarroli
(74) *Attorney, Agent, or Firm*—Renner, Otto, Boisselle & Sklar, LLP

(57) ABSTRACT

An electric plug connector for fastening to a wall, with a plug connector housing, on which, by means of a coupling sleeve, a plugged-in counter-plug connector, in the form of a plug or a jack, is securable, and with a flange plate with a central breakthrough, for receiving and for connecting the plug connector housing to a wall, the flange plate comprising through-bore holes for fastening screws. In the electric plug connector according to the invention the flange plate is implemented as one piece and detachably connected with the plug connector. An internal usable clearance of the central breakthrough of the flange plate corresponds to an outer diameter of a coupling sleeve of the plug connector and/or to an outer diameter of the plug connector housing. This embodiment permits in the radial direction of the plug connector a form-fitting connection of the flange plate with the plug connector housing without a special shape forming of the housing being required for this purpose.

6 Claims, 2 Drawing Sheets

ELECTRIC PLUG CONNECTOR FOR WALL FASTENING

CROSS-REFERENCE TO RELATED APPLICATION

This application claims priority under 35 USC §119 to German Application Number 20 2006 017 885.6, filed Nov. 22, 2006, the entire disclosure of which is incorporated herein by reference.

TECHNICAL FIELD OF THE INVENTION

The invention relates to an electric plug connector for fastening to a wall, with a plug connector housing, on which, by means of a coupling sleeve, a pluggable counter plug connector in the form of a plug or a jack is securable, and with a flange plate with a central breakthrough for receiving and for connecting the plug connector housing to the wall, the flange plate comprising through-bore holes for fastening screws or bolts.

BACKGROUND OF THE INVENTION

A plug connector is disclosed in DE 200 07 171 U1. The publication teaches a device for fastening half of an electric plug connection to a wall, which can be accomplished with little effort by utilizing a flange plate of nonelastic material. The secure fastening of an electric coupling or an electric plug connector to a wall is accomplished by means of the flange plate, whose housing is provided for optional use as a plug connection to be disposed detachedly or stationarily. The flange plate forming the device for fastening the housing is implemented in two parts and, with the flange plate mounted, encloses the housing of the plug connector half between said parts. The two-part implementation of the flange plate makes it possible to connect it from the outside to the housing of the plug connection jack or of the plug connection plug without requiring for this purpose a special shape of the housing, except for the fact that the housing must at least in the axial direction be provided with a smooth outer surface. In particular, this makes it feasible to implement the housing of the plug connection half uniformly for all cases of application as well as through a corresponding disposition of the flange plate to adjust as desired the overhang of the housing of the plug connection half over the surface of the wall to which this half is to be fastened.

In connection with a plug connector half, this type of implementation of the flange plate has been found useful for wall fastening in so far as it can be carried out simply and securely, and it also makes possible the implementation of the housing of the plug connection half such that it is uniform for all applications. However, the complex form of the flange plate parts is a disadvantage. This is a result of the fact that the two parts of the flange plate are snappable with one another via cutouts and projections with undercuts implemented reciprocally on their facing ends. While this measure has the advantage that the two parts of the flange plate can be form-fittingly connected securely with one another in a direction of motion parallel to the axis of the coupling or plug connection half, it also entails the disadvantage that their production is expensive and complex and causes high costs per unit. Simple sealing by means of O-rings is not possible.

SUMMARY OF THE INVENTION

The invention addresses the aforementioned problem by proposing an electric plug connection half, with a flange plate for fastening on walls, in which the flange plate has a simple geometric form and thus can be produced cost-effectively.

In the electric plug connector according to the invention the flange plate is formed as one piece and connected detachably to the plug connector. An internal usable clearance of the central breakthrough of the flange plate corresponds here to an outer diameter of the coupling sleeve of the plug connector and/or to an outer diameter of the plug connector housing. In the radial direction of the plug connector this special implementation permits the form-fit connection of the flange plate to the plug connector housing without a special shape of the housing being required for this purpose. The flange plate connected detachably to the plug connector can easily be removed in the axial direction from the plug connector housing toward the plugging side of the plug connector, and/or, by reversing the direction, can be placed onto the plug connector housing. The flange plate can optionally be guided over a coupling sleeve rotatably fastened on the plug connector housing. It is thus feasible without encountering problems to fasten a plug connector already provided to an electric feed on a wall.

The electric plug connector is one half of an electric plug connection and can be implemented as a plug or a jack. By means of a rotatably fastened coupling sleeve, which can be a part of the plug connector or a part of the counter-plug connector, the counter-plug connector, implemented correspondingly to the plug connector, is securable against unintentional disengagement from the plug connector. Fastening the plug connector on the wall is accomplished by means of the flange plate, which can have any desired outer contour, the conventional square or round form being preferred. In an outer region on the flange plate through-bore holes for fastening screws are provided such that the flange plate can be tightly screwed to the wall. In addition, the flange plate has a central breakthrough for receiving and for connecting the plug connector housing to the wall. The cross sectional form of the central breakthrough is at least in a central region adapted to the cross sectional form of the plug connector housing. Thus, the flange plate is displaceable with low radial play on the plug connector housing in the axial direction and has a thickness in the axial direction which prevents the tilting of the plug connector housing with respect to the flange plate. It is here also essential that the flange plate is detachably fastenable at any desired site on the plug connector housing such that overhang of the wall is variable.

A preferred embodiment provides that the coupling sleeve and/or the plug connector housing and the central breakthrough of the flange plate has a round, substantially cylindrical, cross sectional form which permits any desired orientation of the plug housing with respect to the flange plate in the circumferential direction of the central breakthrough.

It is furthermore of advantage to provide on the flange plate and on the plug connector housing interacting twisting protection devices, which position and maintain the plug connector housing in one or several desired angular positions with respect to the flange plate. This can be carried out, for example, by means of radially oriented projections on the plug connector housing which form-fittingly engage into correspondingly implemented recesses of the flange plate, the projections only being usefully implemented in the central region, associated with the flange plate, of the plug connector housing.

To fix the plug connector housing with respect to the flange plate, retaining means are usefully provided on the flange plate with which, with respect to the flange plate, the plug connector housing is fastenable on the flange plate in a selected position. In the simplest case the fastening can take place through clamping by means of a screw which acts radially onto the plug connector housing. Through the appropriate disposition of the plug connector housing with respect to the flange plate, the overhang of the plug connector over the wall is adjustable. However, other connection types between the flange plate and the plug housing are not excluded.

It is frequently important to protect the space behind the wall against penetrating water, for example splash water. In an advantageous embodiment the flange plate includes for this purpose at least one sealing which seals against the plug connector housing and/or against the wall. For example, an O-ring can be provided as the seal, which O-ring can be placed in the flange plate such that it projects beyond the flange plate on the front side associated with the wall and/or on the shell surface opposite the plug connector housing. During the mounting of the plug connector the O-ring is pressed onto the wall or onto the plug connector housing and securely seals off a gap between the plug connector housing and the wall. Depending on the layout of the seal, class IP 67 protection can be attained for the plug connector.

In a further preferred embodiment of the invention the outer diameter of the coupling sleeve is implemented to be less than or equal to the outer diameter of the plug connector housing. Thus the flange plate can be guided especially easily over the coupling sleeve.

In the following the invention will be explained in further detail in conjunction with an embodiment example depicted in the drawing. Further characteristics of the invention are evident based on the following description of the embodiment example of the invention in conjunction with the claims and the enclosed drawing. The individual characteristics can be realized singly by themselves or in combinations of several of the characteristics in various embodiments of the invention.

DETAILED DESCRIPTION OF THE INVENTION

Figure 1:
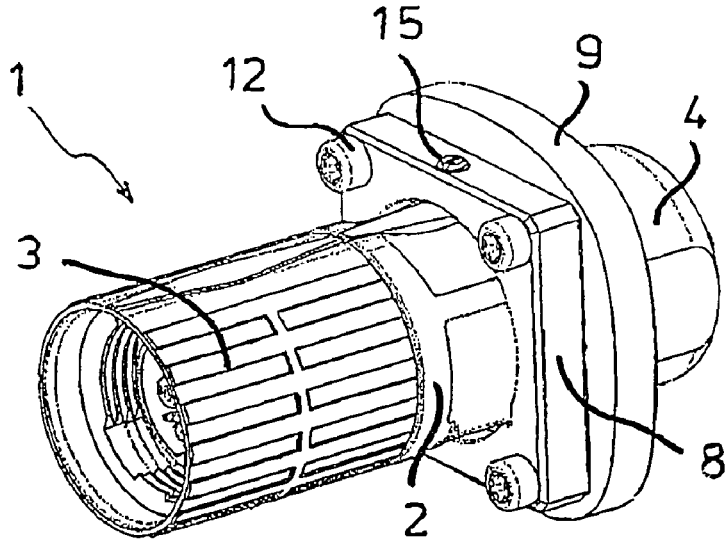
FIG. 1 a perspective view of the electric plug connector according to the invention with mounted flange plate, FIG. 2 a perspective representation of the plug connector of FIG. 1 with dismounted flange plate, and FIG. 3 a side view of the plug connector of FIG. 1.
Figure 2:
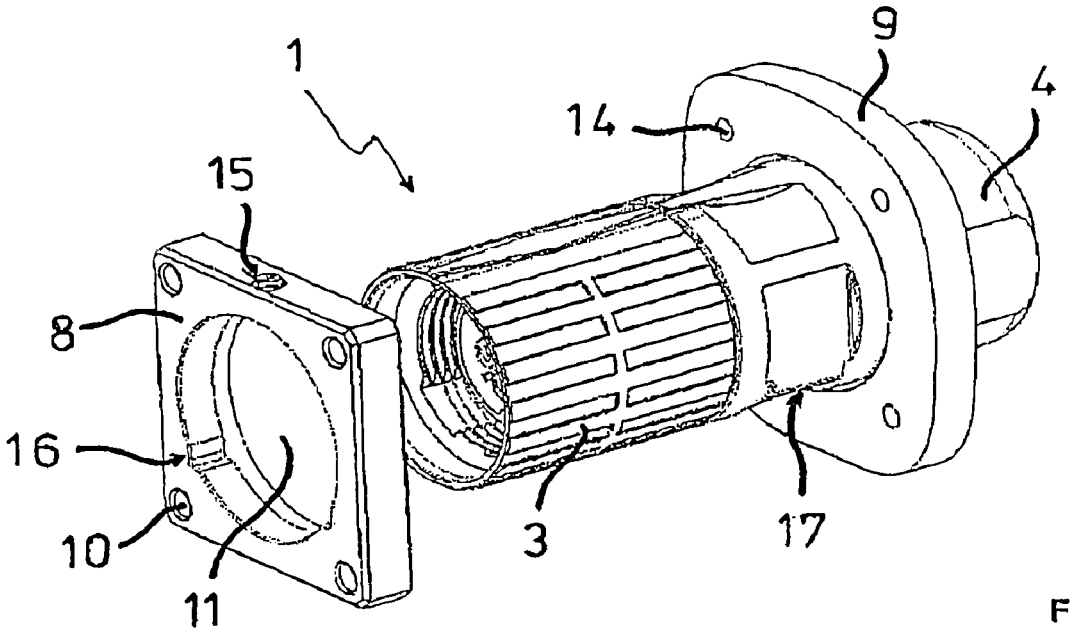
Figure 3:
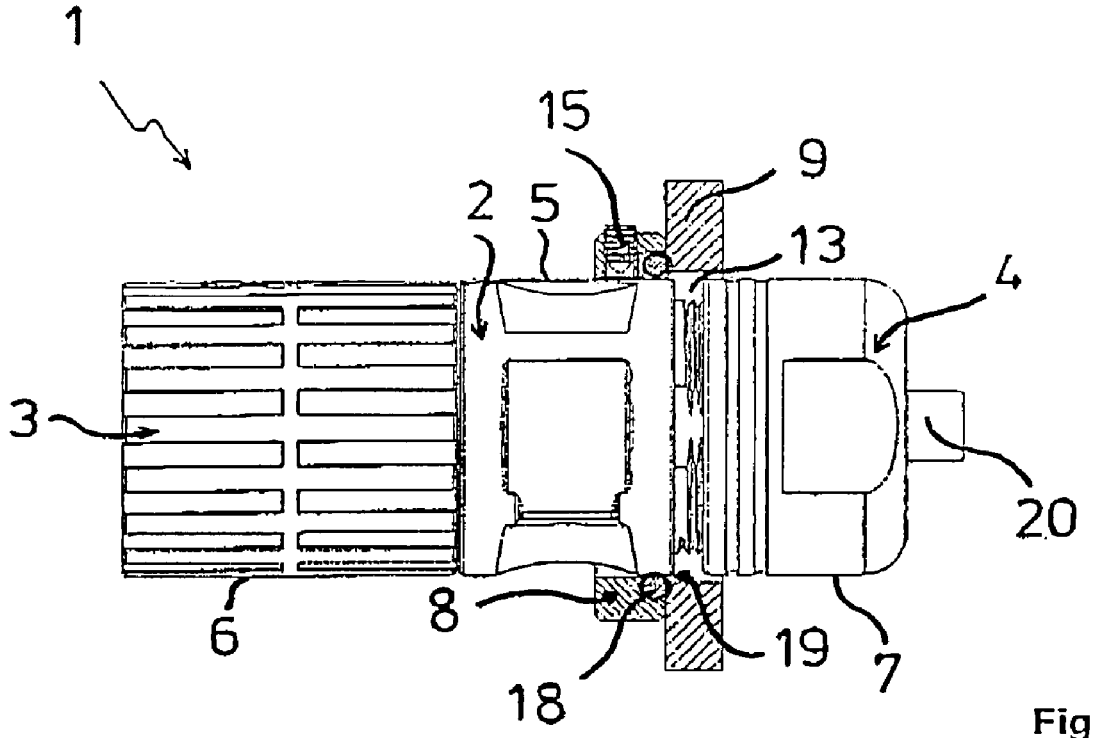

FIGS. 1 and 3 show an electric plug connector 1 according to the invention with a plug connector housing 2, a coupling sleeve 3 and an end cap 4, each having a cylindrical form with identical outer diameter. The outer peripheral surfaces 5, 6, 7 of the plug connector housing 2, of the coupling sleeve 3 and of the end cap 4 are aligned with one another such that they are flush and form with one another a substantially smooth outer contour of the plug connector 1, with no projections. The plug connector housing 2 is fastened by means of a square flange plate 8 to a wall 9. As is evident in FIG. 2, the flange plate 8 comprises for this purpose through-bore holes 10 for receiving fastening screws 12 as well as a central breakthrough 11 for receiving the plug connector housing 2.

For mounting the plug connector 1 provided with an electric feed 20 in the wall 9, a circular mounting opening 13 is provided, which is minimally larger than the outer diameter of the plug connector housing 2. In addition, corresponding to the disposition of the through-bore holes 9 of the flange plate 8, fastening bores 14 are provided around the mounting opening 13 of the wall 9 for fastening the flange plate 8 by means of the fastening screws 12. The flange plate 8 is equipped with a set screw 15 as retaining means for the plug connector housing 2. The set screw 15 enables the axial fixing of the plug connector housing 2 with respect to the encompassing flange plate 8 through clamping and the stepless adjustment of the overhang of the plug connector 1 over the wall 9. For fixing in place the position of the plug connector housing 2 with respect to the flange plate 8 in the circumferential direction of the plug connector 1, twisting protection devices are implemented in the form of recesses 16 and projections 17 on the flange plate 8 or respectively on the plug connector housing 2, which form-fittingly engage into one another in the mounted state.

The plug connector 1 is sealed off against the wall 9. For the sealing an O-ring is provided as seal 18, which seals off a gap 19 between the plug connector housing 2, the one-piece flange plate 8 and the wall 9.

For this purpose the central breakthrough 11 of the flange plate 8 in the radial direction is outwardly stepped on the side associated with wall 9 such that the O-ring 18 projects with respect to plug connector housing 2 in the radial direction and, with respect to wall 9, in the axial direction beyond the flange plate 8. The O-ring 18 is in contact with the wall 9 and with the outer peripheral surface 5 of the plug connector housing 2 and closes off gap 19. By introducing the plug connector housing 2 into the flange plate 8, the O-ring 18 is pressed in the radial direction of the plug connector 1, and, by fastening the flange plate 8 on the wall 9, is pressed in the axial direction of the plug connector 1 and thereby seals off the gap 19 according to protection class IP 67.

Although the invention has been shown and described with respect to certain embodiments, it is obvious that equivalents and modifications will occur to others skilled in the art upon the reading and understanding of the specification. The present invention includes all such equivalents and modifications, and is limited only by the scope of the following claims.

The invention claimed is:

1. An electric plug connector for fastening to a wall, with a generally cylindrical plug connector housing, on which by means of a coupling sleeve a plugged-in counter-plug connector in the form of a plug or a jack is securable, and with a flange plate, which includes a circular central breakthrough for receiving the plug connector housing and for connecting the plug connector housing with the wall, wherein the flange plate for fastening to the wall includes through-bore holes for fastening screws, and wherein the flange plate is implemented as one piece and is detachably connected with the plug connector housing and an internal usable clearance of the central breakthrough of the flange plate corresponds to an outer diameter of the coupling sleeve and/or of the plug connector housing of the plug connector, and wherein the flange plate is fastenable on the plug connector housing at any desired site in a central region of the plug connector housing for stepless adjustment of an overhang of the plug connector housing over the wall.

2. A plug connector as claimed in claim 1, wherein the coupling sleeve and/or the plug connector housing and the central breakthrough of the flange plate have a round cross sectional shape.

3. A plug connector as claimed in claim 1, wherein the flange plate and the plug connector housing comprise twisting protection devices.

4. A plug connector as claimed in claim 1, wherein the flange plate comprises retaining means for fixing the plug connector housing.

5. A plug connector as claimed in claim 1, wherein the flange plate comprises at least one seal which seals against the plug connector housing against the wall.

6. A plug connector as claimed in claim 1, wherein the outer diameter of the coupling sleeve is implemented such that it is less than or equal to the outer diameter of the of the plug connector housing.

* * * * *